US006276275B1

(12) United States Patent
Schäfer

(10) Patent No.: US 6,276,275 B1
(45) Date of Patent: Aug. 21, 2001

(54) INK FOUNTAIN HAVING SENSORS TO DETERMINE PRESENCE OF A ROLL OF INK

(75) Inventor: Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/319,946

(22) PCT Filed: Dec. 22, 1997

(86) PCT No.: PCT/DE97/03000

§ 371 Date: Aug. 30, 1999

§ 102(e) Date: Aug. 30, 1999

(87) PCT Pub. No.: WO98/28136

PCT Pub. Date: Jul. 2, 1998

(30) Foreign Application Priority Data

Dec. 21, 1996 (DE) ..... 196 53 813

(51) Int. Cl.[7] ..... B41F 31/00; B41F 31/02

(52) U.S. Cl. ..... 101/483; 101/350.1; 101/367

(58) Field of Search ..... 101/335, 348, 101/349.1, 350.1, 350.6, 351.1, 352.01, 364–367, 484, 494, DIG. 45, 483; 222/25–29, 56, 64

(56) References Cited

U.S. PATENT DOCUMENTS

| | | |
|---|---|---|
| 2,399,688 | 5/1946 | Metzner et al. . |
| 3,631,800 | 1/1972 | Mignore et al. . |
| 3,730,089 | 5/1973 | McCutcheon . |
| 4,385,558 | 5/1983 | Takahashi et al. . |
| 5,560,294 | 10/1996 | Anders et al. . |

FOREIGN PATENT DOCUMENTS

| | | |
|---|---|---|
| 19 38 525 A | 2/1970 | (DE) . |
| 0 663 293 | 7/1995 | (EP) . |
| 2 299 546 A | 10/1989 | (GB) . |
| 55055869 | 5/1983 | (JP) . |
| 62116151 | 5/1987 | (JP) . |
| 62244640 | 10/1987 | (JP) . |
| 6186072 | 7/1994 | (JP) . |

OTHER PUBLICATIONS

Patent Abstract of Japan, vol. 13, No. 146 (p–854), Apr. 11, 1989, & JP 63 309805 A (Sumitomo Heavy Ind. LTD), Dec. 16, 1988.

*Primary Examiner*—Kimberly L. Asher
(74) *Attorney, Agent, or Firm*—Jones, Tullar & Cooper

(57) ABSTRACT

The density or size of an ink roll, which is formed in an ink fountain of a rotary printing press, is determined either directly or indirectly at several spaced locations. The measured values are then evaluated. A signal is generated to an ink feed device, or a warning signal can be transmitted in accordance with the size or density of the ink roll and its deviation from reference values.

2 Claims, 12 Drawing Sheets

INK FOUNTAIN HAVING SENSORS TO DETERMINE PRESENCE OF A ROLL OF INK

FIELD OF THE INVENTION

The present invention relates to a method for determining the presence of roll of ink in a pressureless ink fountain of a rotary printing press, as well as to several associated devices.

DESCRIPTION OF THE PRIOR ART

A device for inking a screen roller is known from EP 0 663 293 A1, wherein ink rotates around a longitudinal axis parallel with the screen roller in a filled ink chamber of circular cross section.

A negatively pitched working doctor blade and a positively pitched finishing doctor blade are provided.

U.S. Pat. No. 2,399,688 describes a device for maintaining the filling level in an ink fountain constant.

GB 2 299 546 shows a device for placing ink into an ink fountain, which can displaced in the longitudinal direction on a carriage. Sensors for monitoring the fill level of the ink in the ink fountain are fastened on the carriages.

SUMMARY OF THE INVENTION

The object of the present invention is based on providing a method as well as a device, by means of which it can be determined whether build-up of ink forming a roll of ink is formed in an ink fountain in the course of the running of the press.

In accordance with the invention, this object is attained by measuring ink thickness values, the thickness of a rotating built-up roll of ink or the partial hydrostatic pressure exerted on a side wall of an ink fountain. The measured values are evaluated and are used to determine the presence of a built-up roll of ink and its size.

The advantages which can be achieved by means of the invention consist, in particular, in that the thickness of the built-up roll of ink being formed in the course of the running of the press is determined continuously or at intervals, and that an electrical, optical and/or acoustic signal is issued in case of a deviation from a nominal value. In accordance with the value and the direction of the deviation, either a signal for controlling the ink delivery device or a warning signal for the operator is issued.

BRIEF DESCRIPTION OF THE DRAWINGS

Several preferred embodiments of the invention are represented in the drawings and will be described in greater detail in what follows. Shown are in.

DESCRIPTION OF THE PREFERRED EMBODIMENTS

Figure 1:
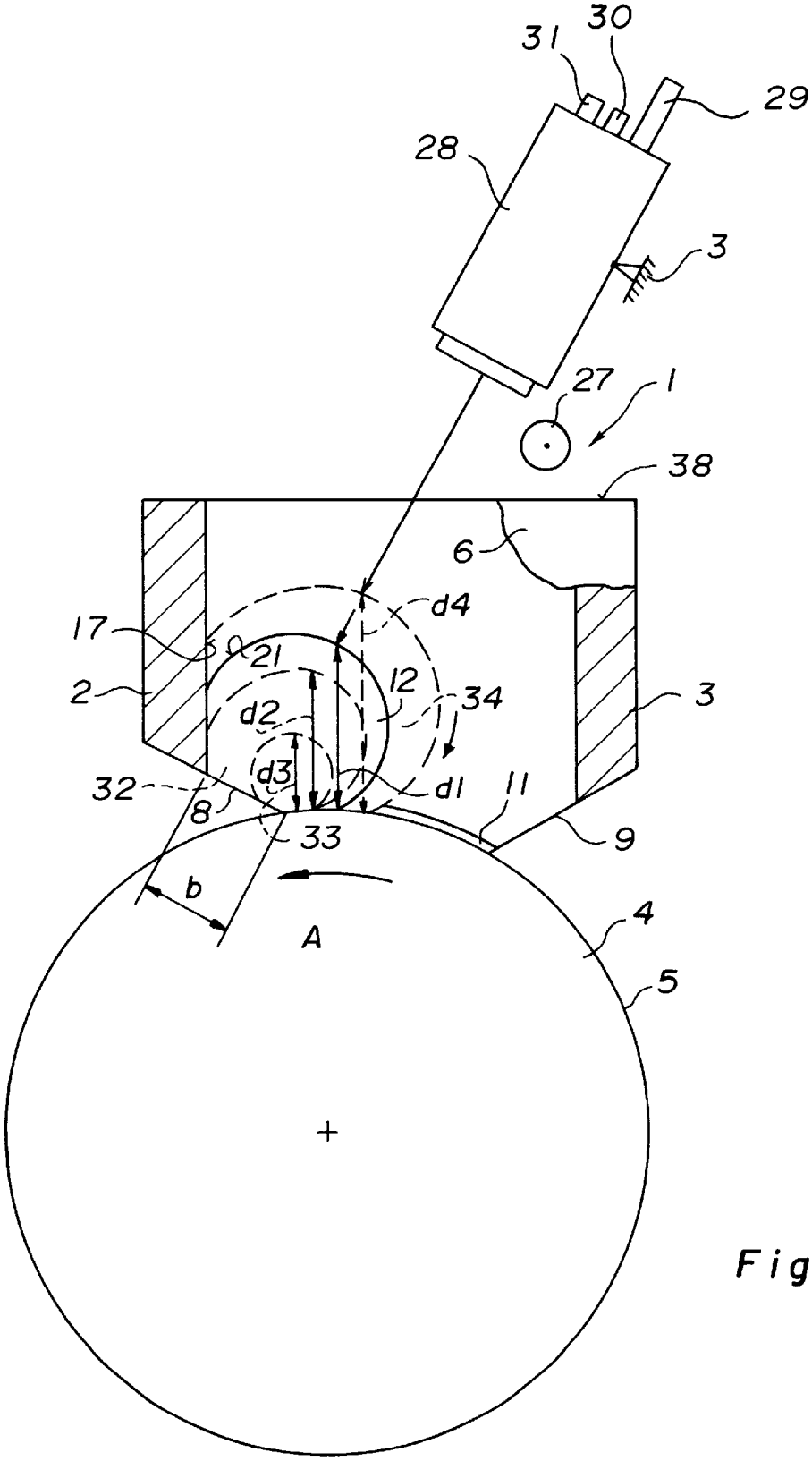
FIG. 1, a schematic representation of a cross section through an ink fountain placed on a roller, which has a device in accordance with a first preferred embodiment.

An ink fountain 1, which is typically a pressureless ink fountain, open at the top, has a left and a right lateral wall

2, 3, as well as two sealing front or end walls 6, 7, which are matched to the periphery of a driven roller 4. The ink fountain 1 extends over the entire length of the roller 4 which, for example, can be embodied as a screen roller or as a rotogravure cylinder. A working doctor blade 8 as well as a finishing doctor blade 9 are exchangeably attached at the bottom of the lateral walls 2, 3.

In place of the doctor blades 8, 9 it is also possible to employ ink metering blades arranged next to each other over the length of the roller 4.

Preferably highly viscous ink 11 having a viscosity greater than 60 poise is placed into the ink fountain 1, which in the course of the operation of the press forms a build-up of ink forming a roll of ink 12 that rotates or rolls in accordance with the direction of rotation of the roller 4, for example in a counterclockwise direction A and, which is in contact with the left inside 17 of the lateral wall 2 as well as the free width b as well as the length of the doctor blade 8. The doctor blade edge of the doctor blade 8 removes ink from the surface 5 of the roller 4.

At a defined position of its length, the rotating built-up roll of ink 12 has a nominal thickness d1, which is proportional to the used-up and replenished ink from the ink fountain 1. Measurements are performed continuously or at intervals by means of a device 28, which is directly or indirectly oriented toward the built-up roll of ink 12 and fixed in place on the lateral frame or on the ink reservoir, and the result of the measurements is evaluated.

The measurement of the distance takes place selectively by means of optical or acoustic means, for example laser beams or ultrasonics, which are emitted by the device 28 and impinge directly and contact-free on the surface 21 of the built-up roll of ink 12. The thickness d1 of the built-up roll of ink 12 is then determined on the basis of the known distance between the surface 5 of the roller 4 and the device 28.

Because of the delivery of ink 11 from the ink fountain 1 to the ink roller 4 during the operation of the press, a built-up roll of ink 32 of a reduced thickness d2 is formed—represented in dashed lines -. Thereupon the device 28 issues a signal which starts an ink pump, not represented, which supplies the ink fountain 1 with fresh ink via the ink delivery device 27.

In case of a large negative deviation d3 or a large positive deviation d4 of the thickness of the built-up roll of ink 33, 34—represented in dashed lines -, an optical or acoustic warning signal is emitted, which draws the attention of the operator to an error in the inking unit.

The device 28 is connected by means of an electrical or optical conductor 29 with the control post of the press. The time interval to be measured, as well as the fixed distance value, can be set by means of preselector switches 30, 31.

As represented by dashed lines in the drawings, the device 28 can be arranged projecting past the upper edge 38 of the ink fountain 1. It is also possible to provide measurements by means of a device operating on a capacitive basis.

Moreover, the device 28 can also be arranged over the length of the ink fountain 1 on a guide rail, which is fastened parallel with the roller, and can be displaced manually or by means of a motor.

Figure 10:
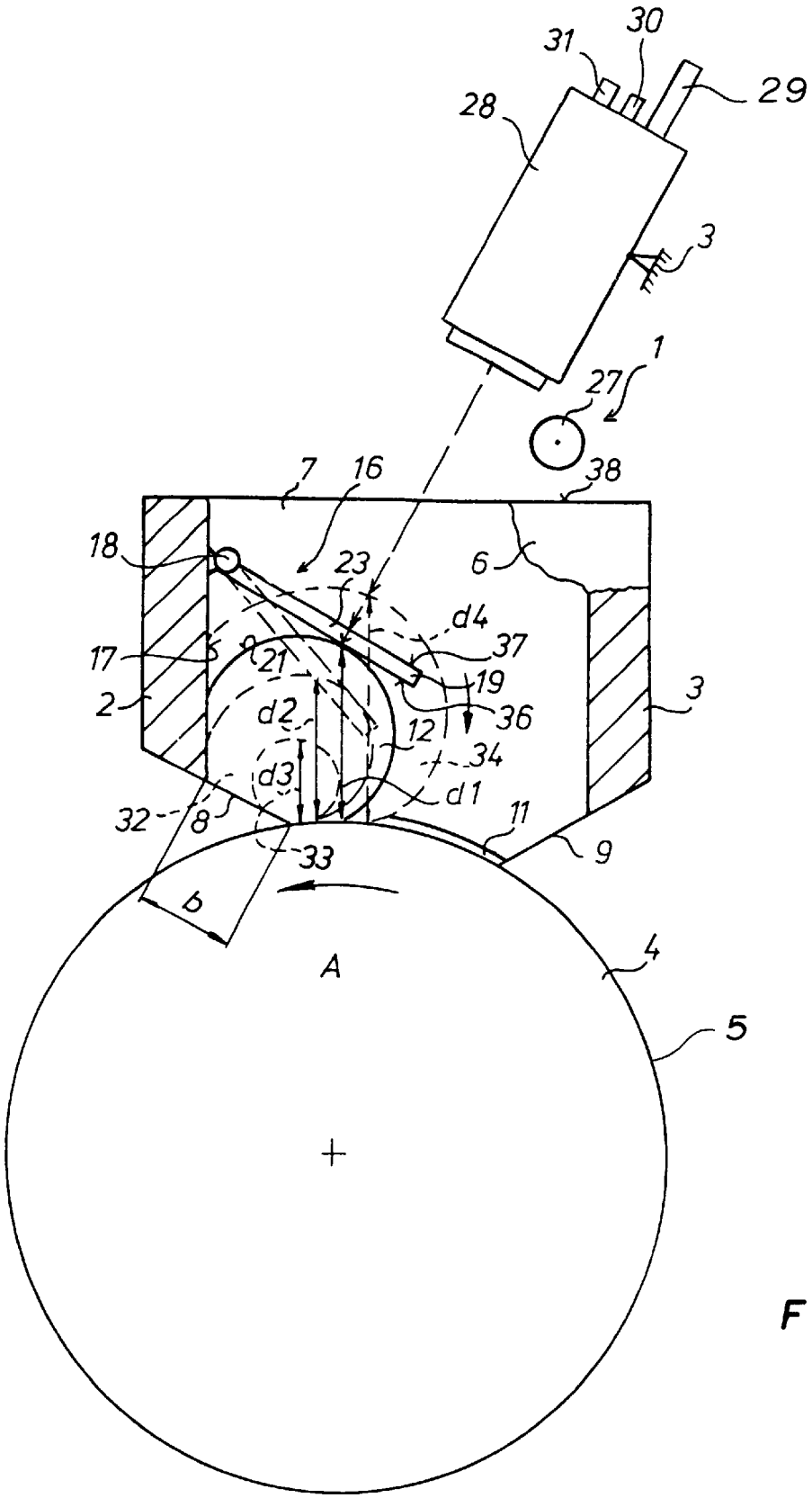
FIGS. 10, 11, and 12 schematic representations of an ink fountain placed on a roller with further embodiments of the present invention.

In accordance with another preferred embodiment of the present invention, as depicted in FIG. 10, a built-up roll of ink sensing lever 23 is hinged on a bearing 18 fastened on the inside 17 of the left lateral wall 2, whose underside 36 rests tangentially on the periphery 21 of the built-up roll of ink 12. In this way, a distance between the top 37 of the sensing lever 23 and the device 28 is measured indirectly and by contact, so that it is possible by taking into consideration the thickness of the material of the sensing lever 23, to determine the various thicknesses d1 to d4 of the built-up roll of ink 12, 32, 33, 34.

Figure 11:
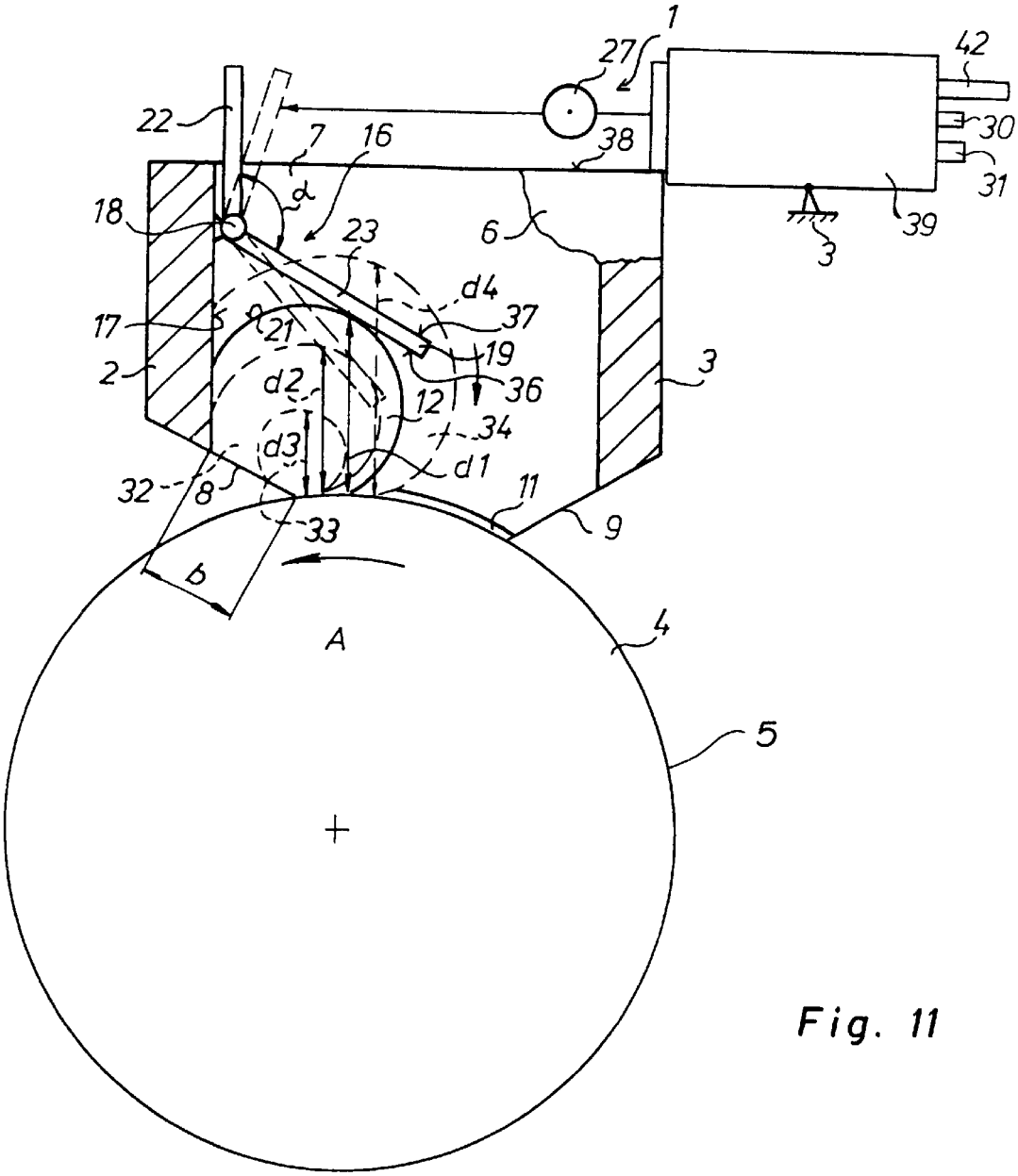

In accordance with a third preferred embodiment, as seen in FIG. 11, the sensing lever 23 can be part of a double-armed sensing lever assembly 16, whose second arm 22 points in the direction toward the opening of the ink fountain 1 and which joins the first arm 23 in the bearing 18 at an angle , for example of 130° to 140°. A device 39, that is the same as device 28, is arranged on the upper edge 38 of the right lateral wall 3 and measures a horizontal distance between the device 39 and the second arm 22, again in an indirect and contacting manner, while the underside 36 of the first arm 23 rests against the periphery 21 of the built-up roll of ink 12.

The position of the two-armed sensing lever assembly 16 changes as a function of the thickness d1 to d4 ofthe built-up roll of ink 12, 32, 33, 34, so that the device 39, 16 determines the thickness of the built-up roll of ink. The device 39 can be designed in the same way as the device 28.

Figure 12:
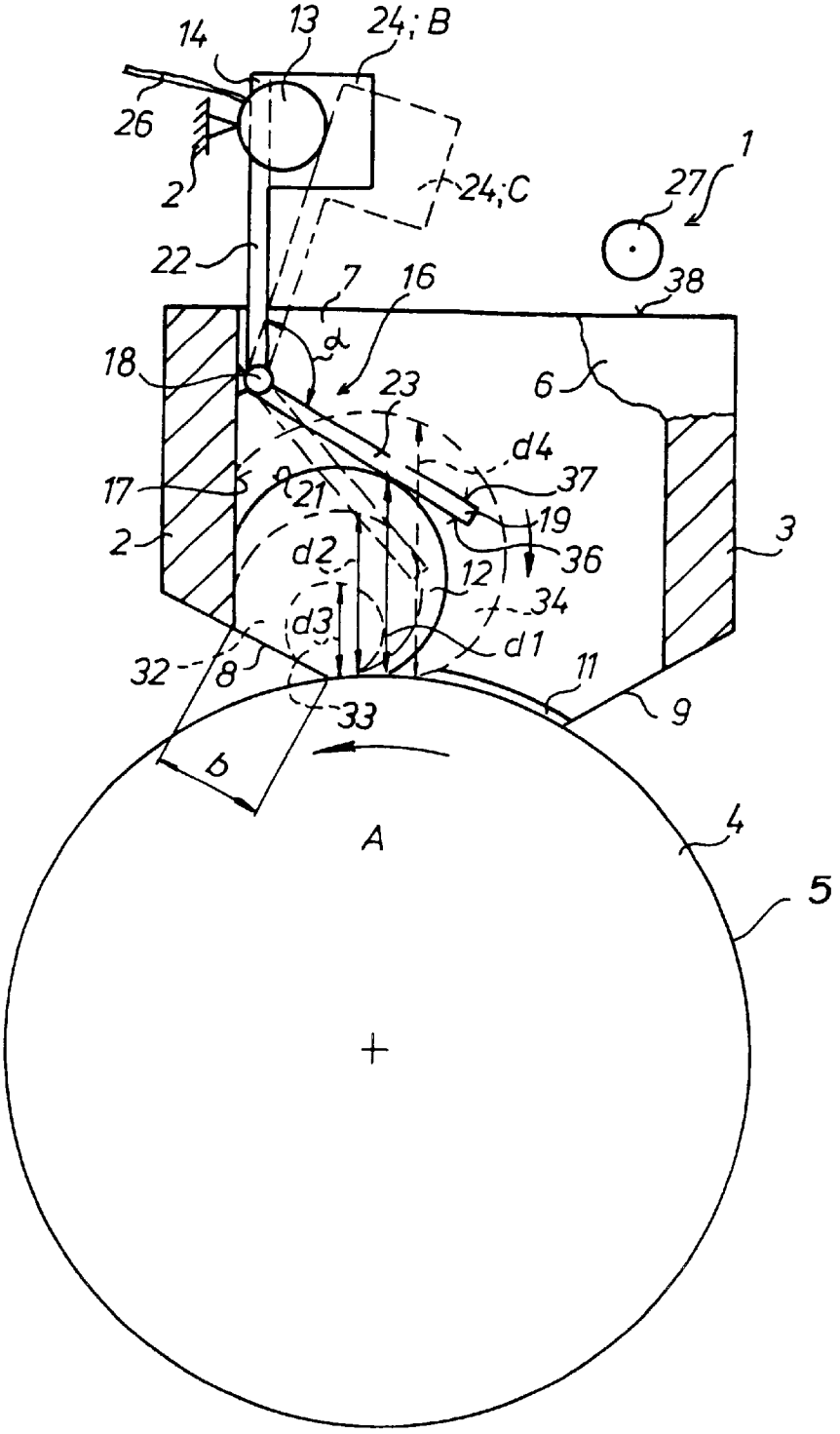

In accordance with a fourth preferred embodiment, depicted in FIG. 12, the two-armed sensing lever assembly 16 has a vane 24 at the end of its second arm 22, which is in contactless connection with an inductive device 13, for example. The vane 24 can be made of sheet metal. The underside 36 of the first arm 23 of the two-armed sensing lever 16 rests tangentially against the built-up roll of ink 12 of a thickness d1, so that the sensing lever 16 is in a first, solid line position. The amount of ink is reduced in the course of the operation of the press, so that a resultant built-up roll of ink 32 now has a reduced thickness d2. In this case, the sensing lever 16 is in second position—represented by dashed lines -. A signal for the control of the ink delivery device 27 is emitted by the device 13, so that the built-up roll of ink again attains the nominal thickness d1.

The device 13 is arranged fixed in place on the lateral frame or on the ink fountain and is connected via an electrical conductor 26 with the control post of the press.

Of course, the device can also be set in such a way that a short turn-on of the ink delivery device 27 can immediately take place with even a lesser reduction of the nominal thickness d1. The thickness of the built-up roll of ink is preferably scanned continuously or at preselectable time intervals.

The number of intervals d1, d2, d1 occurring in the course of a correct printing operation—taking into consideration the ink surface portion of the material to be printed as well as the number of revolutions of the press—is advantageously determined during a preselected length of time, for example of five minutes, by means of a known evaluation circuit. For example, five intervals are created within a preselected length of time of five minutes.

If the preselected number of intervals falls below this, this is a sign for the wrong formation of the built-up roll of ink and therefore a sign for an erroneous delivery of the amount of ink. In this case an additional alarm signal is emitted.

The principle of the methods of the present invention lies in that the ink fountain 1 is filled with ink, for example highly viscous ink, in such a way that during the operating stage a part of the lower ink fountain 1 is free of ink, while a built-up roll of ink 12 is formed in the other lower part of the ink fountain 1. This status is determined by means of further exemplary embodiments and is evaluated.

Figure 2:
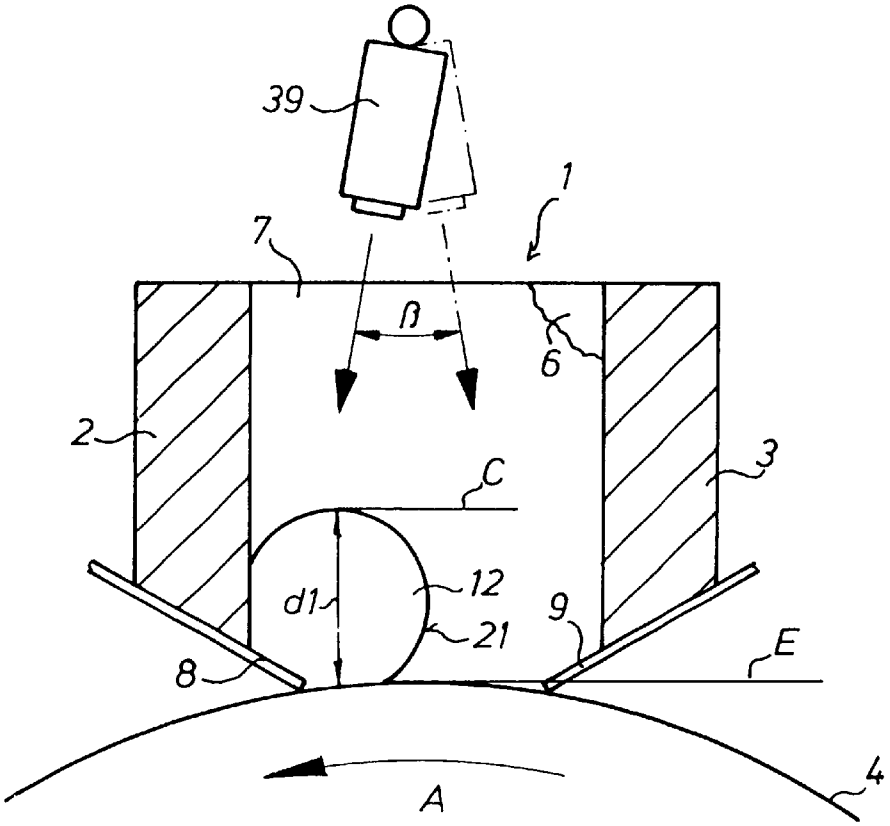
FIGS. 2 to 9, further embodiment variations of devices for executing the method.

In accordance with a fifth preferred embodiment, as seen in FIG. 2, a measuring device 39, for example an ultrasonic sensor or a running time sensor, is arranged above the ink fountain 1, which measuring device 39 can be pivoted over an angle βof approximately 20° in the circumferential direction of the roller 4, for the contactless measurement of the thickness d1 of the, built-up roll of ink 12 in a continuous manner or at intervals. This measuring device 39 measures the distance from the planes C and E. Based on a preselected nominal difference between both planes C, E, it is possible to determine whether sufficient ink 11 is present, or respectively whether a built-up roll of ink 12 has been formed at all.

Figure 3:
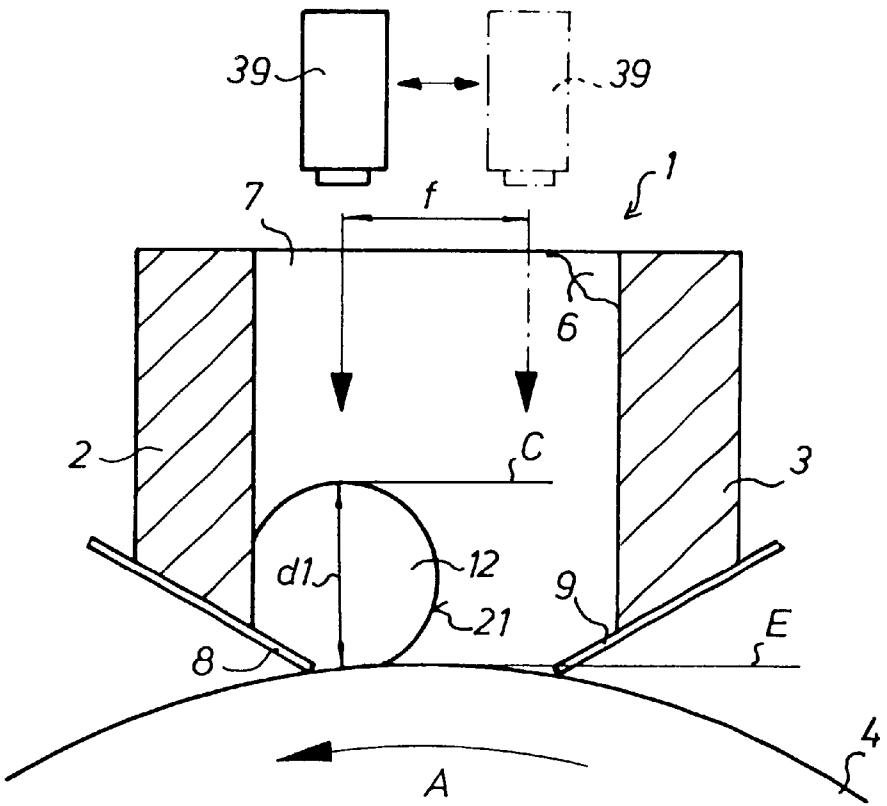

In accordance with a sixth preferred embodiment, as seen in FIG. 3, a measuring device 39 is arranged above the ink fountain 1, and which device 39 can be displaced in the circumferential direction of the roller 4 by an amount f, for example corresponding to half the width of the ink fountain 1. The measuring device 39 operates as described in connection with the fifth preferred embodiment, and can be moved back and forth on a rail fixed in place on the lateral frame by means of a linear drive which is not represented.

Figure 4:
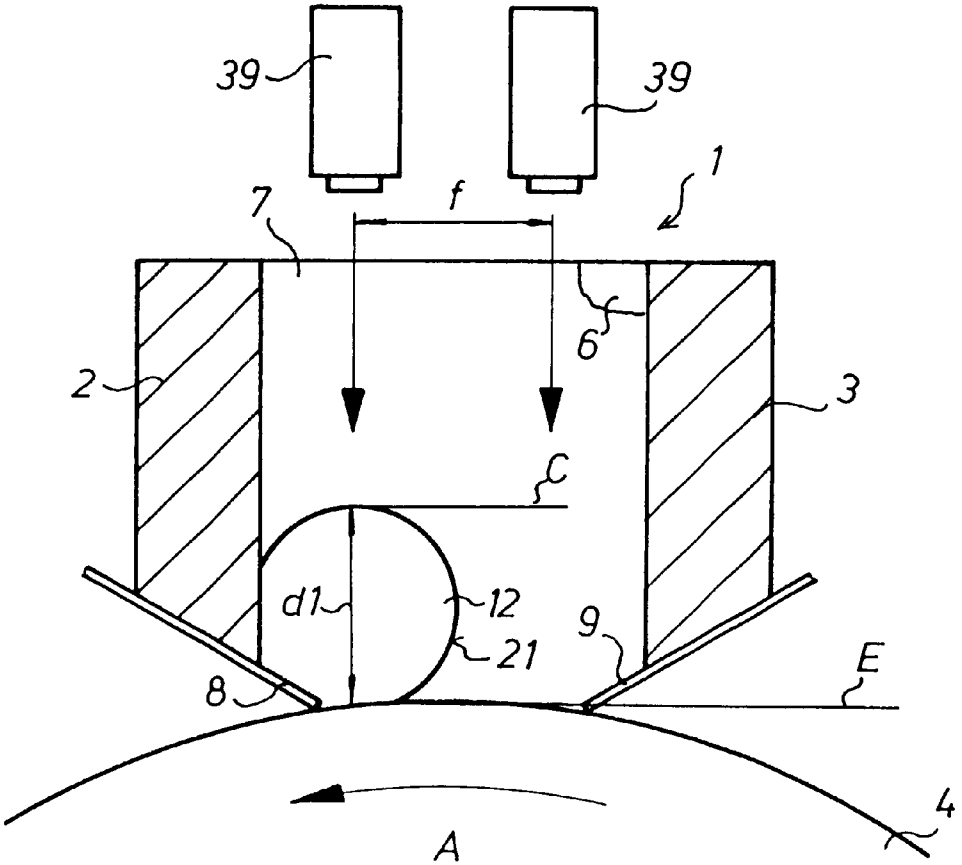

In accordance with a seventh preferred embodiment, as seen in FIG. 4, spaced measuring devices 39 are arranged fixed in place above the ink fountain 1, and which are spaced from each other by an amount f. The left measuring device 39 determines the distance from the plane C, and the right measuring device 39 determines the distance from the plane E. The measuring method operates as described in connection with the fifth preferred embodiment.

Figure 5:
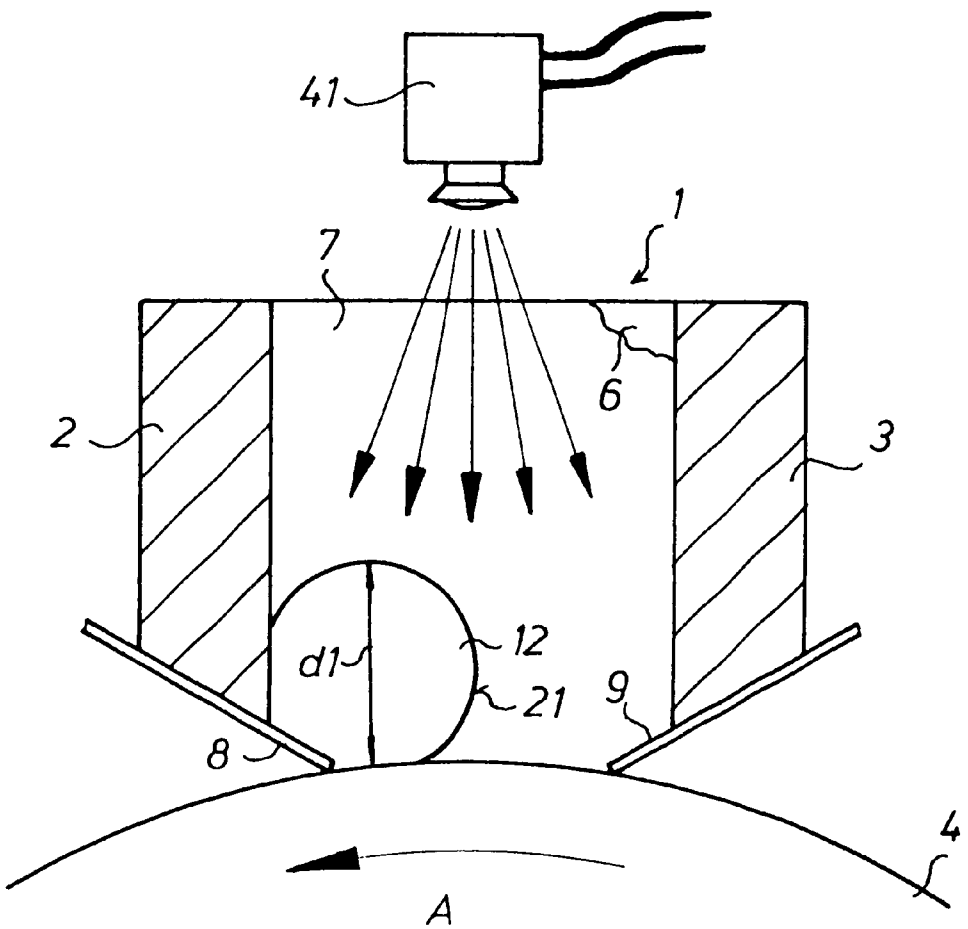

In accordance with an eighth preferred embodiment, as seen in FIG. 5, a CCD camera 41 is arranged above the ink fountain 1, by means of which the actual formation of the built-up roll of ink 12 is detected, which is compared with a nominal formation of the built-up roll of ink stored in a computer. In case of deviations outside of the tolerance range, appropriate signals are emitted, the same as in connection with the previous exemplary embodiments.

Figure 6:
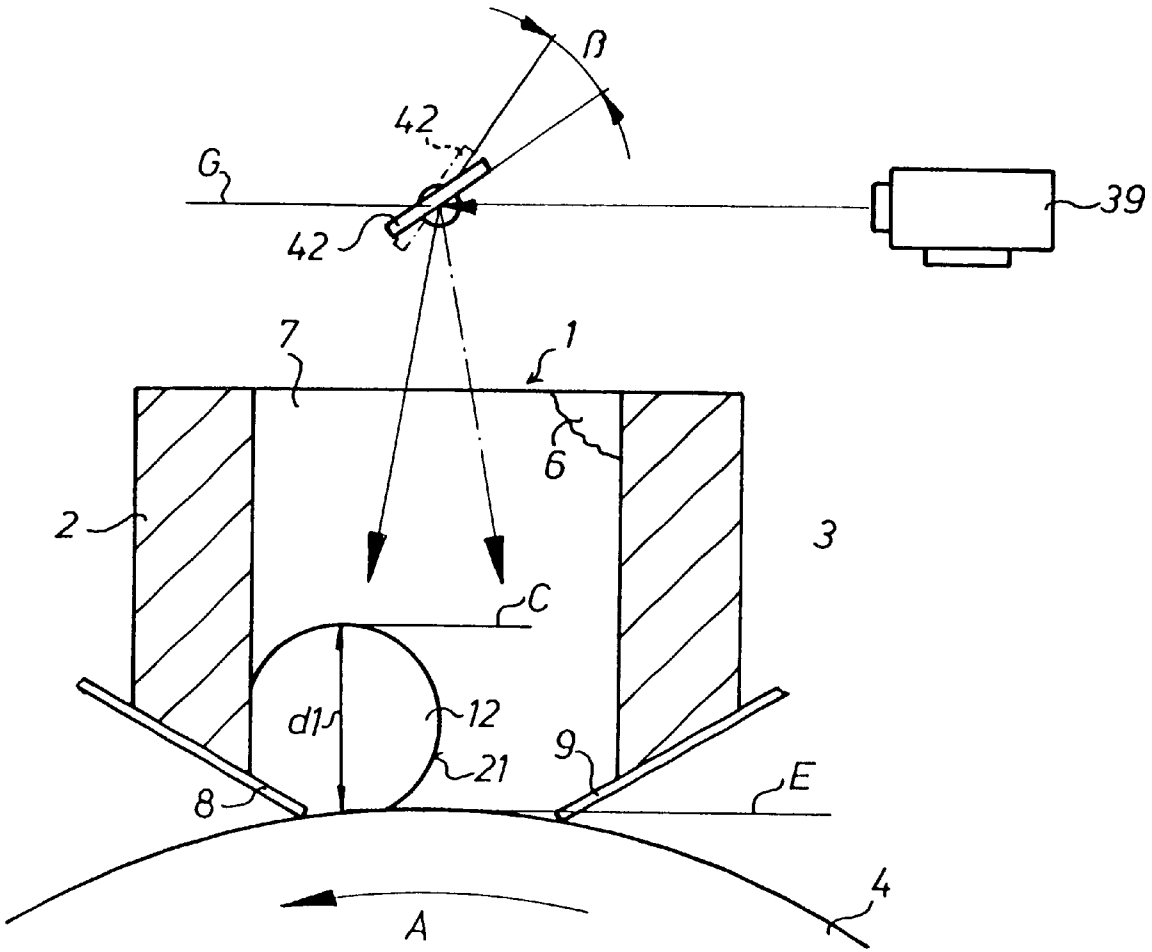

In accordance with a ninth preferred embodiment, as seen in FIG. 6, a measuring device 39 is arranged on a plane G located above the ink fountain 1, and which works together with a pivotable mirror 42 located above the ink fountain 1. The mirror 42 can be pivoted around an angle β, of approximately 20°, for example by means of an electromagnet which is not represented, which can be returned into the initial position by a spring force. The mirror 42 selectively directs the measuring beam on the surface 21 of the built-up roll of ink 12 (plane C) or on the plane E.

Figure 7:
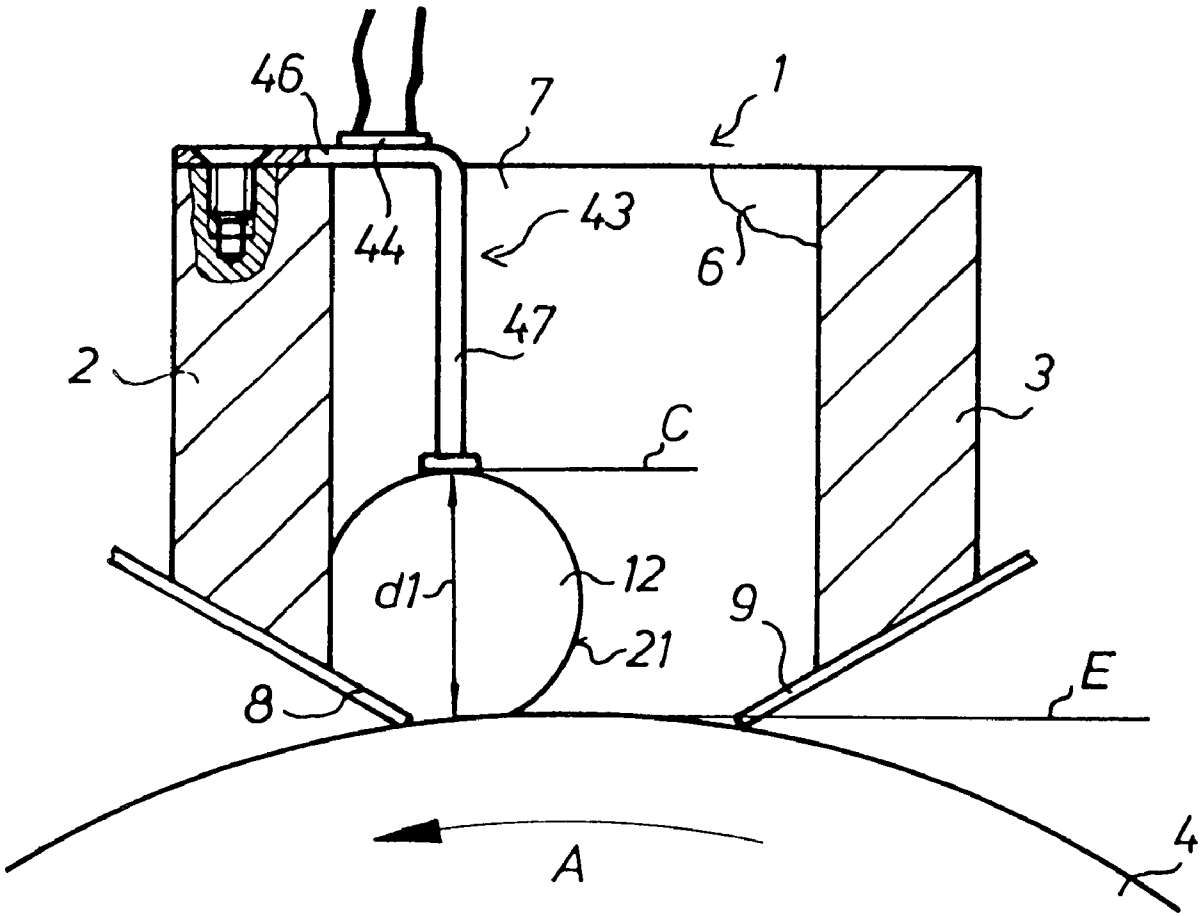

In accordance with a tenth preferred embodiment, as seen in FIG. 7, a measurement at intervals of the thickness d1 of the built-up roll of ink 12 in a plane C takes place by means of an angled lever 43, which is fixed in place on the ink fountain and touches the surface 21 of the built-up roll of ink 12 in a radial direction. The angled lever 43 is designed in an L-shape, for example. A first leg 46 of the angled lever 43 is fastened on the surface of the lateral wall 2 and has a wire strain gauge 44. The second leg 47 extends vertically and parallel with the lateral wall 2. The plane C is at an approximate distance from the surface of the roller 4 which corresponds to the diameter d1 of a built-up roll of ink 12, as seen in FIG. 7. It is furthermore possible to also arrange the wire strain gauge 44 on the second leg 47 of the angled lever 43.

Figure 8:
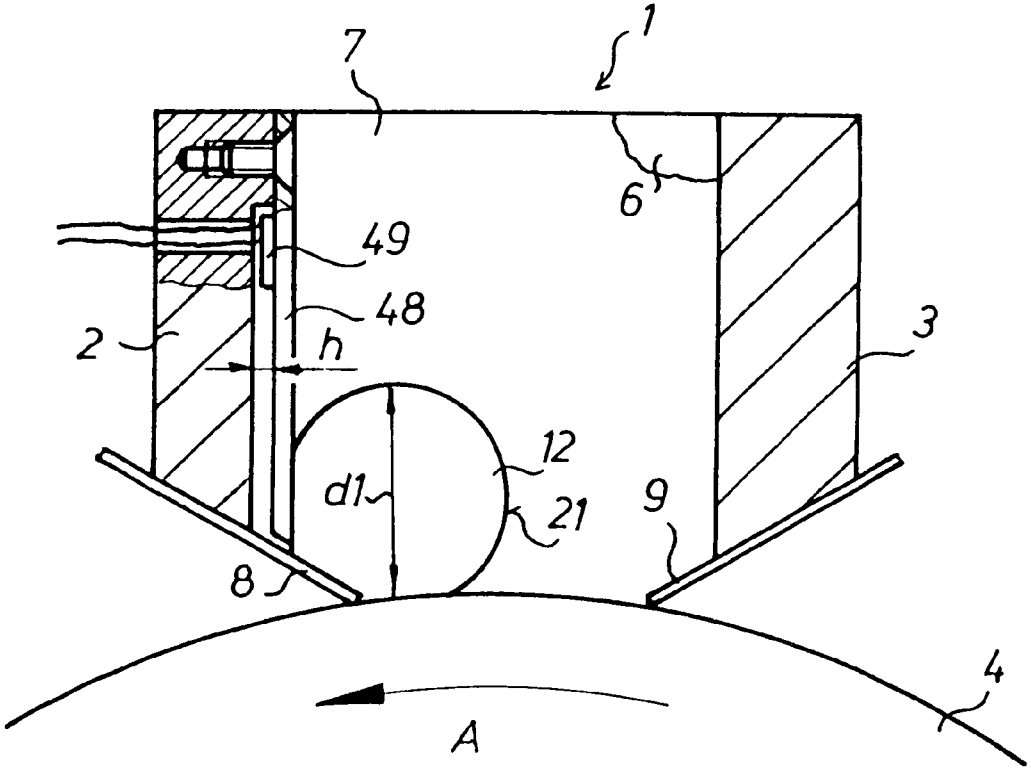

In accordance with an eleventh preferred embodiment, as seen in FIG. 8, the lateral walls 2 and/or 3 are set back in the direction toward the interior of the ink fountain 1. The depression created by this is covered by a flexible piece of sheet metal 48. It is fastened, at an upper portion, to the lateral wall 2, or respectively 3, and with its lower end either cooperates with the inside of the doctor blades 8 and 9 to form a very narrow gap, or rests on them. At least one wire strain gauge 49 has been applied on the inside of the flexible piece of sheet metal 48, which projects into the depression. A bending moment is generated by the contact of the rotating built-up roll of ink 12 with the flexible piece of sheet metal 48, which bending is detected by the wire strain gauge 49, which emits a corresponding signal, which is evaluated. It is also possible to detect oscillations by means of the wire strain gauge, which are evaluated and are used as an indicator of a rotating movement of the ink roll 12.

The distance h can be up to several millimeters.

However, it is also possible to arrange an elastic material, for example silicon caoutchouc, between the support 48 and the lateral wall 2.

In accordance with another embodiment which is not specifically represented, at least one of the lateral walls has a pressure-measuring pickup. A signal is emitted when the ink roll 12 comes into contact with the pressure-measuring pickup.

Figure 9:
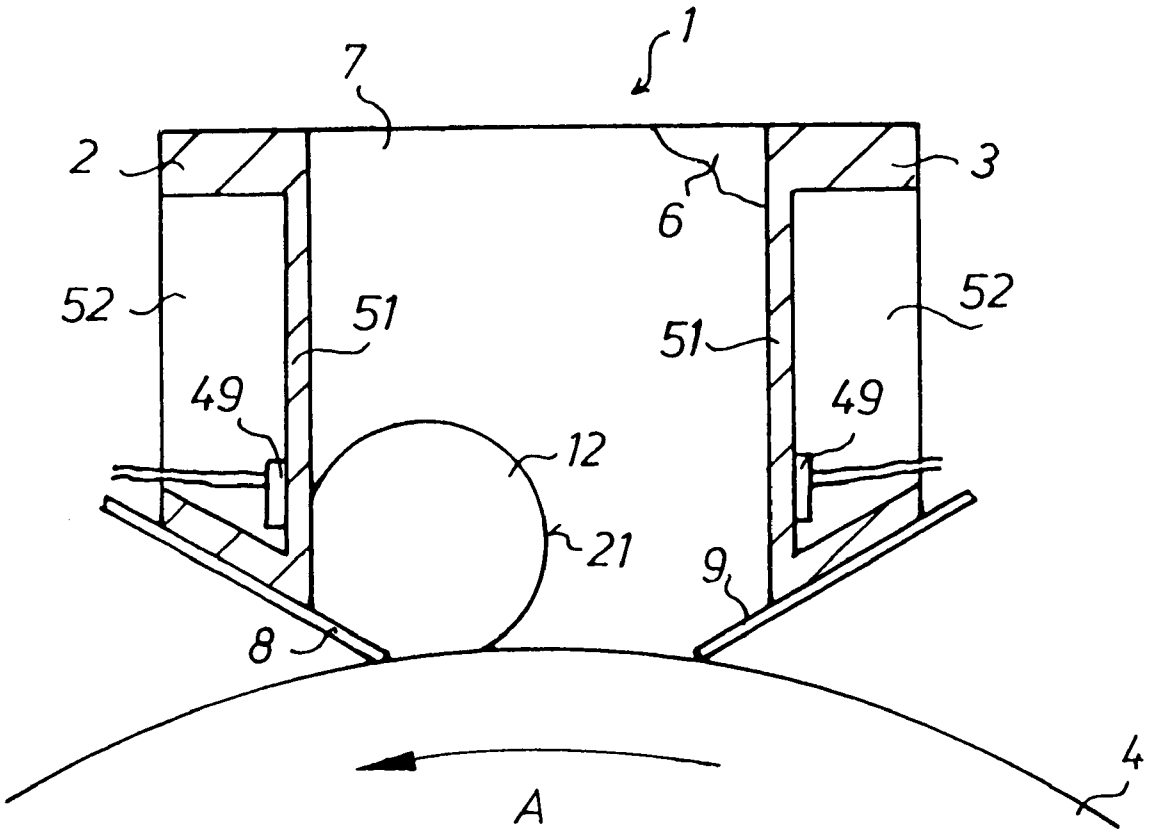

With the preferred embodiment in accordance with FIG. 9, the device operates the same as with the subject of FIG. 8. In place of a flexible piece of sheet metal 48 with a lower free end, a flexible piece of sheet metal 51 is now used, which is fastened on the top and bottom on the lateral wall 2 and/or 3 and in this way covers a depression or opening 52 in them—sealed against the entry of ink.

The "flexible piece of sheet metal" can, as shown in FIG. 9, also be created by the removal of material from the lateral wall 2 and/or 3 from the outside. Because of this, the lateral wall 2, 3 can be stressed by bending because of the hydrodynamic forces generated by the rotating built-up roll of ink 12. These generated bending stresses can be detected by means of wire strain gauges 49 and evaluated. They are a measurement for determining whether the built-up roll of ink 12 rotates. This can also be determined in another way by means of the wire strain gauges 49. It is possible to electronically evaluate the oscillations, by means of which the rotating built-up roll of ink 12 excites the flexible piece of sheet metal 51, from the signals of the wire strain gauges.

While preferred embodiments of an ink fountain in accordance with the present invention have been set forth and completely hereinabove, it will be apparent to one of the skill in the art that a number of changes in, for example the specific printing press, the ink supply device and the like could be made without departing for the true spirit and scope of the present invention which is accordingly to be limited only by the following claims.

What is claimed is:

1. A method for determining the presence of a built-up roll of ink in an ink fountain of a pressureless rotary printing press including the steps of:

providing an ink fountain and a cooperating rotatable ink fountain roller;

forming a built-up roll of ink in said ink fountain during rotation of said ink fountain roller;

providing a built-up roll of ink thickness measuring device;

positioning said built-up roll of ink thickness measuring device cooperatively with said built-up roll of ink;

using said built-up roll of ink thickness measuring device and measuring a thickness of said built-up roll of ink located inside said ink fountain at at least two measuring points separated from each other in a circumferential direction of said ink fountain roller in said ink fountain; and evaluating results of said measuring of said thickness of said built-up roll of ink.

2. A method for measuring the presence of a built-up roll of ink in an ink fountain of a pressureless rotary printing press including the steps of:

providing an ink fountain and a cooperating rotatable ink fountain roller;

forming a built-up roll of ink in said ink fountain during rotation of said ink fountain roller;

arranging first and second built-up roll of ink thickness measuring devices above said ink fountain and separating said first and second measuring devices by a distance in a circumferential direction of said ink fountain roller;

using said first and second built-up roll of ink thickness measuring devices and measuring a thickness of said built-up roll of ink located inside said ink fountain; and evaluating results of said thickness of said built-up roll of ink.

* * * * *